US008689371B2

(12) United States Patent
Pittman

(10) Patent No.: US 8,689,371 B2
(45) Date of Patent: Apr. 8, 2014

(54) HYGIENIC BENCH TOWEL

(76) Inventor: Wintrell Pittman, Memphis, TN (US)

( * ) Notice: Subject to any disclaimer, the term of this patent is extended or adjusted under 35 U.S.C. 154(b) by 562 days.

(21) Appl. No.: 12/927,977

(22) Filed: Dec. 1, 2010

(65) Prior Publication Data

US 2012/0137431 A1 Jun. 7, 2012

Related U.S. Application Data

(60) Provisional application No. 61/399,401, filed on Jul. 12, 2010.

(51) Int. Cl.
*A47G 9/06* (2006.01)
*A63B 26/00* (2006.01)

(52) U.S. Cl.
USPC ..... 5/417; 5/420; 482/142

(58) Field of Classification Search
USPC ..... 5/417, 420; 15/118, 209.1; 482/148, 482/142; 2/69; 297/228.12; D21/676, 686, D21/690
See application file for complete search history.

(56) References Cited

U.S. PATENT DOCUMENTS 1,914,796 A * 6/1933 Badgley ..... 15/222
3,916,447 A * 11/1975 Thompson ..... 2/46
4,766,626 A * 8/1988 Green ..... 5/420
6,224,152 B1 * 5/2001 Hughes et al. ..... 297/256.17
6,343,391 B1 * 2/2002 Le Gette et al. ..... 5/417
6,640,359 B1 * 11/2003 Alane ..... 5/420
7,007,322 B2 * 3/2006 Alane ..... 5/417
7,066,535 B2 * 6/2006 Moses ..... 297/229
2005/0204501 A1 * 9/2005 Golec ..... 15/209.1
2006/0189463 A1 * 8/2006 Boice et al. ..... 482/148
2008/0004168 A1 * 1/2008 Jackson ..... 482/148
2008/0115250 A1 * 5/2008 Tousant ..... 2/69
2008/0201882 A1 * 8/2008 Hay et al. ..... 15/118
2009/0255060 A1 * 10/2009 Biggs ..... 5/417
2010/0178821 A1 * 7/2010 Morris ..... 442/1

* cited by examiner

*Primary Examiner* — William Kelleher
*Assistant Examiner* — Eric Kurilla
(74) *Attorney, Agent, or Firm* — Carrithers Law Office PLLC

(57) ABSTRACT

A hygienic bench towel for covering an exercise bench before a user sits on the bench to protect the user from sweat, germs and contamination left by a previous user. The bench towel has a semi rigid handle which enables a user to move the towel form one bench to another without touching the contaminated side of the towel. Another advantage provided by the handle is that the user always knows which side of the towel should be placed against the workout bench The towel is provided with spaced apart tabs at that end of the towel which is draped over the back of the bench to allow the towel to conform to framework which may be present at the center of the back of the bench. The handle is located on the towel so that the tabs don't become contaminated when the towel is moved using the handle. When the user is finished with the towel, the user folds the towel using the uncontaminated tabs and places the towel in a bag for transport to laundry services. One embodiment of the bench towel contains ties for rigidly securing the towel to a bench.

4 Claims, 4 Drawing Sheets

HYGIENIC BENCH TOWEL

This application claims priority from U.S. provisional Patent Application No. 61/399,401 which was filed on Jul. 12, 2010 and which is incorporated by reference herein.

TECHNICAL FIELD

The present invention relates to the towels which are used to cover the surface area which user may touch on exercise and workout benches to protect the user from contamination left by previous users.

BACKGROUND OF THE INVENTION

Spa's and gyms are used by thousands of people every day all over the world. A common problem encountered in gyms and spa's is the lack of cleanliness and sanitation of the workout equipment. A typical user prefers to sit on a workout bench which is clean and germ free. However, this is not always practical due to contamination left by previous users. Therefore, typical users who are careful to avoid the sweat germs and other contamination left by previous equipment users will cover a workout bench with a clean towel before sitting on and using that bench. With the clean towel in place, the user can work out without touching any contaminated surface on the bench.

However, when a user wants to reuse the towel on another bench, that user may forget which side of the towel was against the bench and with which side the user was in contact. Further, the user may inadvertently touch the contaminated side of the towel when moving the towel.

Another problem with typical towels exists due to the fact that workout benches often have structural framework at the upper back of the bench. Typical rectangular bath towels don't conform well to this structural framework. Therefore, a better design for a towel to be used over the back of such a bench would be one which has two spaced apart panels which will straddle the structural framework. A towel including such panels would tend to cling to or hold onto the back of a workout bench better than a standard, rectangular towel.

DESCRIPTION OF THE RELATED ART

Common rectangular towels are used for protection from sweat and germs in gyms. However, common towels don't provide a solution to the problem caused when a user inadvertently touches the wrong side of a used towel or the problem of forgetting which side of a used towel a user should have facing down when the user moves to another workout bench. Another problem with common bath towels is the lack of spaced apart panels which will straddle the structural framework which is commonly present at the upper rear center of the back of a workout bench. No prior art which solves the above problems is known to the applicant.

SUMMARY OF THE INVENTION

In accordance with the present invention, there is provided a hygienic bench towel to be used on the surface of a workout bench for protecting a user from contamination, sweat and germs, comprising a generally rectangular absorbent cloth containing spaced apart panels at a first end thereof and having a gap formed therebetween. The panels are configured to straddle the structural framework located at the top rear center of the back of a workout bench and are capable of balancing the weight of and holding the remaining portion of the towel over the workout bench securely in place. The towel also contains a strap attached to the absorbent cloth at a position half way between the edge of a second end of the cloth and an edge of the gap adjacent to the point where the panels are connected to the generally rectangular cloth. The strap is attached to and reaches across the entire width of the generally rectangular cloth and is parallel to the edge of the second end of said cloth. The strap has a handle portion formed therein at the center and the handle portion forms a generally semi-circular loop and extends outward from the cloth.

It is an object of this invention to provide a bench towel which has a semi rigid strap and handle to be used for moving the towel without touching a contaminated surface of the towel.

It is an object of this invention to provide a bench towel which contains spaced apart panels which can straddle the structural framework commonly used at the top rear center of a workout bench.

It is an object of this invention to provide a bench towel wherein the handle is placed so that when a user moves the towel with the handle, the panels hang freely and don't contact contaminated surfaces of the towel.

It is an object of this invention to provide a bench towel wherein the semi-rigid strap is stiff enough to remain generally straight when the towel is supported by the handle, thereby preventing the towel from hanging limp.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
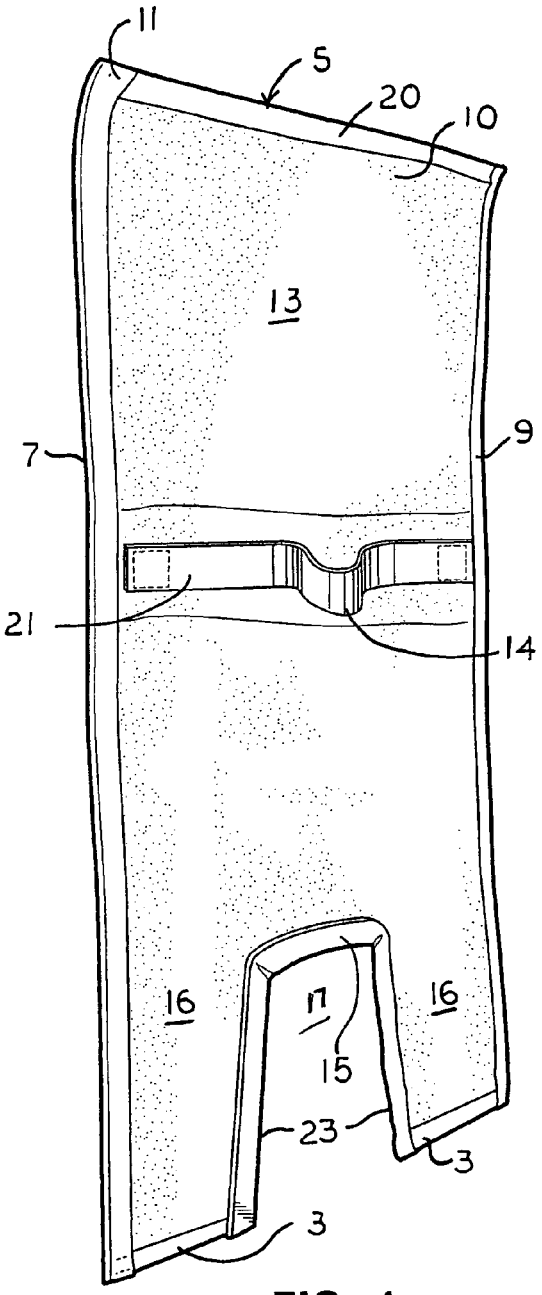
FIG. 1 is a front perspective view of the bench towel.
Figure 2:
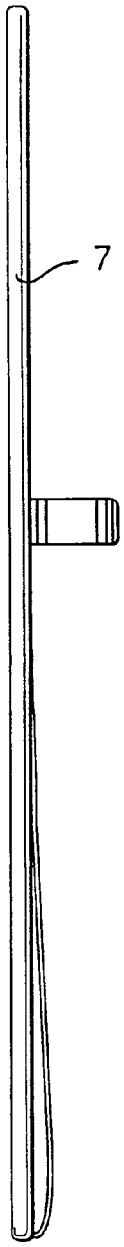
FIG. 2 is a left side view of the bench towel.
Figure 3:
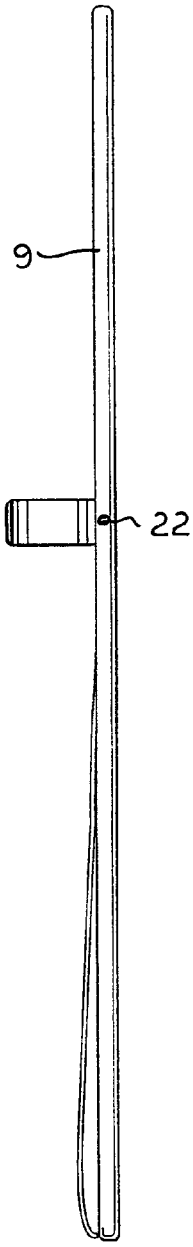
FIG. 3 is a right side view of the bench towel.

In accordance with the present invention, there is provided one preferred embodiment comprising a bench towel 5 including a generally rectangular, absorbent cloth 10 including a border 11 formed by folding over the edges of the towel 10 and sewing a seam thereon. A continuous strip of material defining a strap 12 is sewn along its length onto a selected surface 13 of on one side of the towel 10 at a selected position normal to the length of the towel 10 whereby said loop extends from a first side edge 7 to a second side edge 9 wherein a center portion of the strap includes an unsewn portion or length of strap 12 forming a semi-loop or handle portion 14 extending outwardly therefrom. As shown in FIGS. 1-8, handle 14 is configured to gape outward and away from cloth 10, thus enabling a user to easily grasp the handle 14. Cloth 10 is preferably made of terrycloth, paper, cloth, synthetic fiber, including combinations and blends thereof. The portion 21 of the strap 12 sewn to the towel 10 may be stitched onto the cloth using a single or double stitched extending up the center of the strap or along each side of the strap or over any portion of the strap 12.

Figure 4:
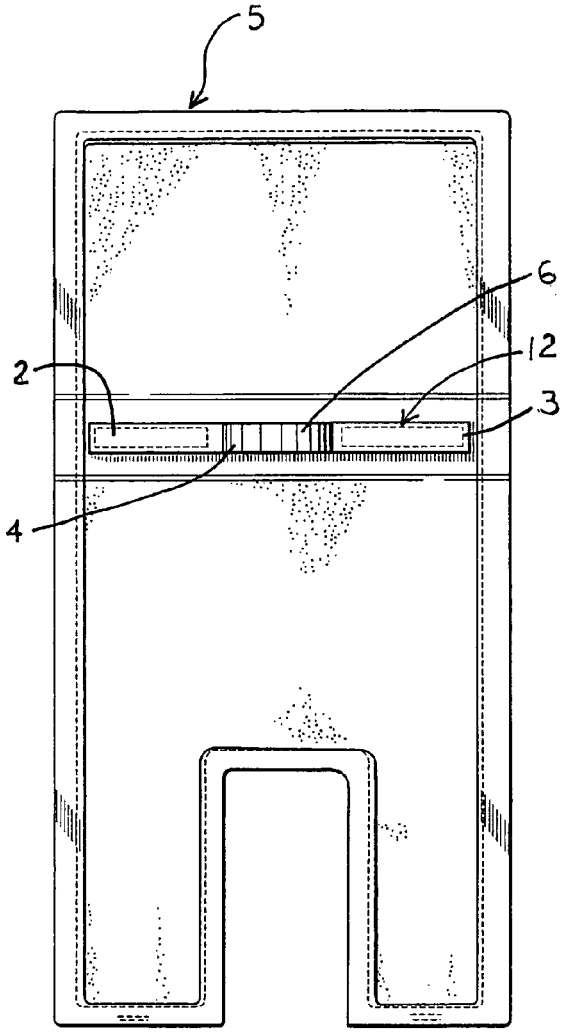
FIG. 4 is a front view of the bench towel.
Figure 5:
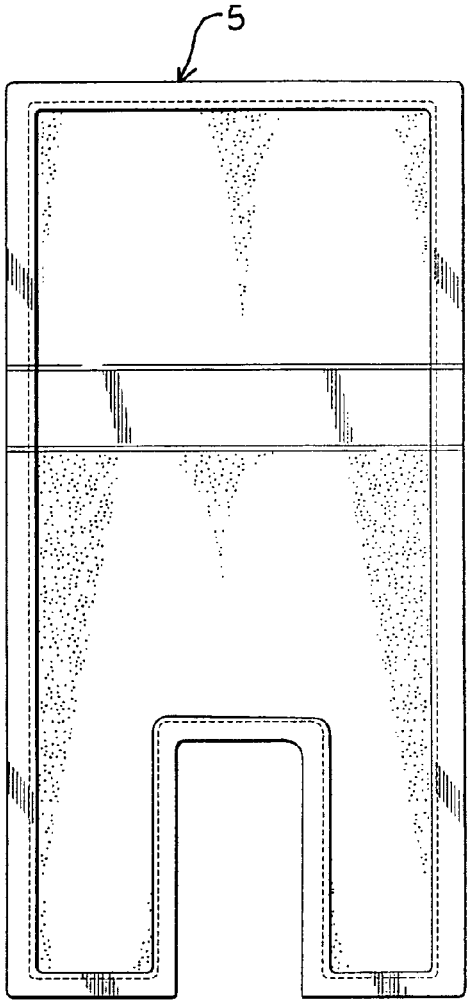
FIG. 5 is a rear view of the bench towel.
Figure 6:
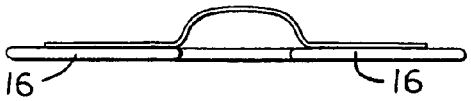
FIG. 6 is a top view of the bench towel.
Figure 7:
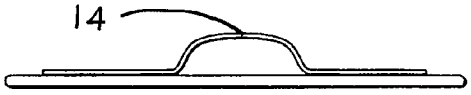
FIG. 7 is a bottom view of the bench towel.
Figure 8:
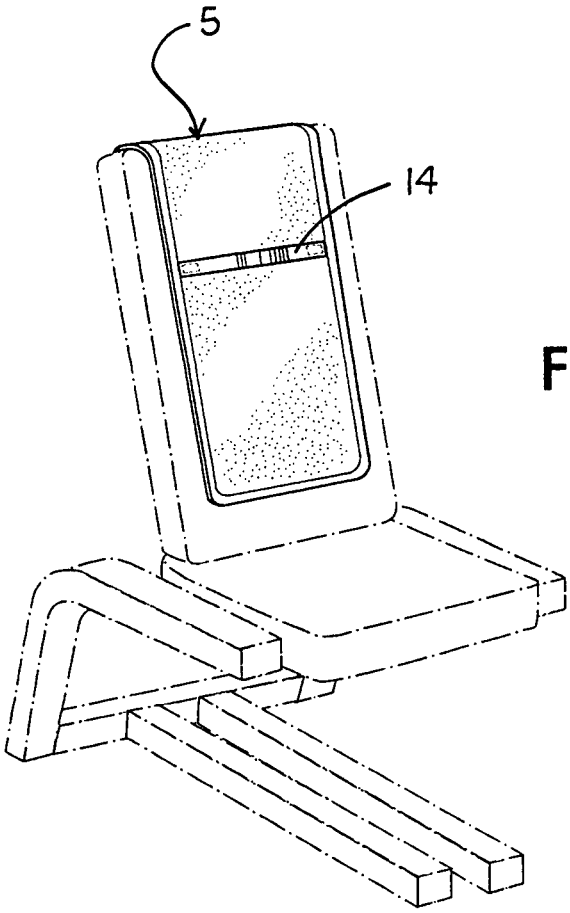
FIG. 8 is a front perspective view of a workout bench with a bench towel.

An alternate embodiment comprising a bench towel 5 including a generally rectangular, absorbent cloth 10 including a border 11 formed by folding over the edges of the towel 10 and sewing a seam thereon. Two strips of material 2, 3 defining a strap 12 is sewn along its length onto a selected surface 13 of on one side of the towel 10 at a selected position normal to the length of the towel 10 whereby a strip of material 2 extends from a first side edge 7 and a strip of material 3 extends from a second side edge 9 toward a center portion of the towel where the distal ends of the straps 4, 6, overlap and fastened together by a hook and loop fastener such as VELCRO, forming a semi-loop or handle portion 19 extending outwardly therefrom. As shown in FIG. 4, handle 14 is configured to gape outward and away from cloth 10, thus enabling a user to easily grasp the handle 14. Cloth 10 is preferably made of terrycloth, paper, cloth, synthetic fiber, including combinations and blends thereof. The portion of the strap 12 sewn to the towel 10 may be stitched onto the cloth using a single or double stick extending up the center of the strap or along each side of the strap or over any portion of the strap.

In the preferred embodiments, the strap 12 and handle 14 are made from similar or the same material as cloth 10 and may comprise a single, double or triple layer or any multilayer type of material to provide some rigidity. Moreover the strap can comprise any flexible material. Strap 12 and handle 14 are sewn onto cloth 10 parallel to the top edge 20 and at a location half way between the top edge 20 of towel 5 and the top edge 15 of a pair of panels 16 defining tails extending along the edges 7, 9 from a bottom edge 3 of the main towel body and ending about ⅓ of the way toward the center forming medial side edges 23 and a medial interior edge 15 defining an alignment gap 17 therebetween. This placement of handle 14 provides for the carrying of towel 5 by handle 14 while tope edge 20 is adjacent to medial interior edge 15 and panels 16 hang freely without touching any contaminated surface 13 of towel 5. When the towel 5 is supported by the handle 14, strap 12 is rigid enough to remain generally straight so that cloth 10 doesn't hang limp but rather retains a generally neatly folded shape so as to keep uncontaminated surfaces 33 from touching contaminated surfaces 13. A removable stiffener 22 such as a plastic strip, rod or longitudinal member may be included in a pocket under strap 12 or cooperatively engaged using means for securing to provide increased rigidity to the handle.

Figure 9:
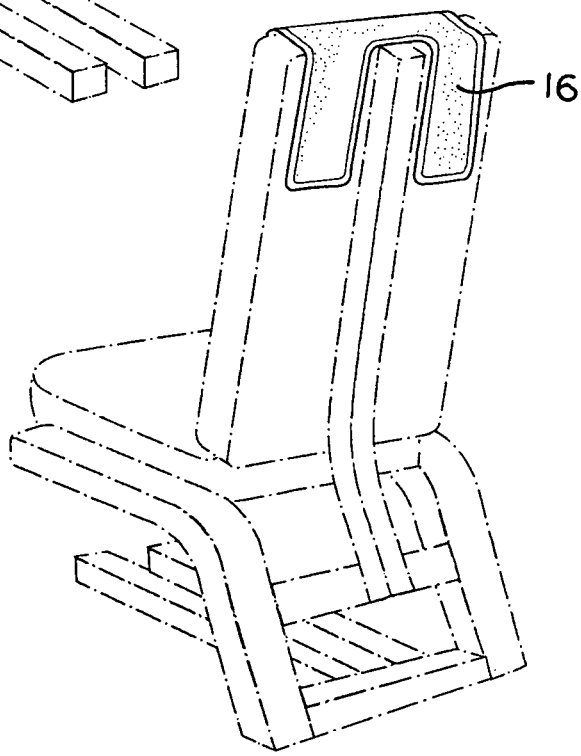
FIG. 9 is a rear perspective view of a workout bench with a bench towel.
Figure 10:
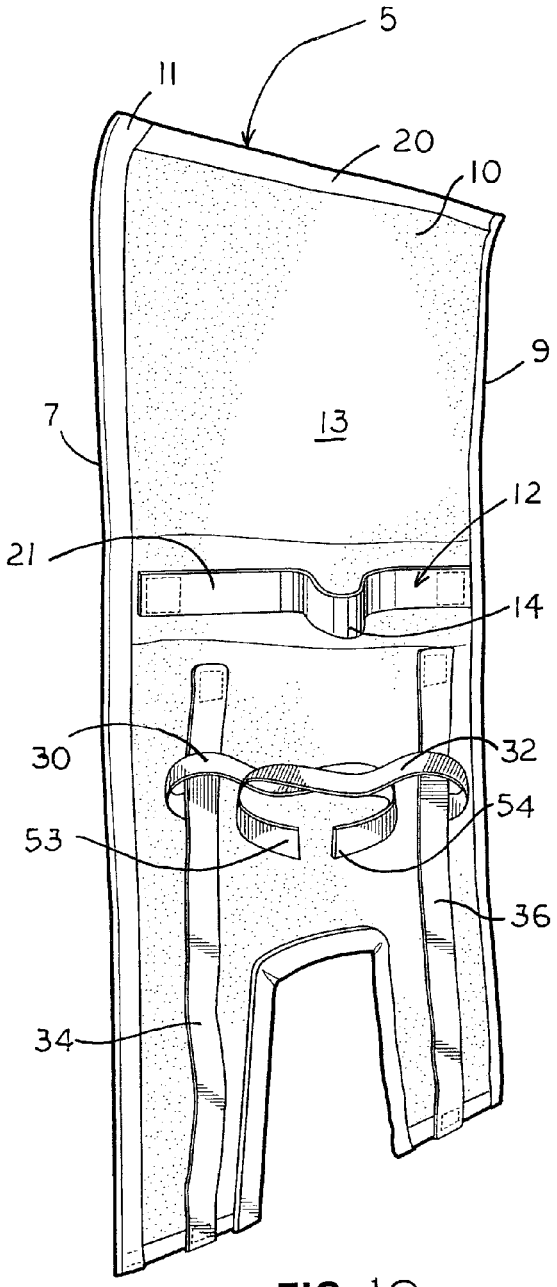
FIG. 10 is a front perspective view of a bench towel including ties for securing the towel to a bench.
Figure 11:
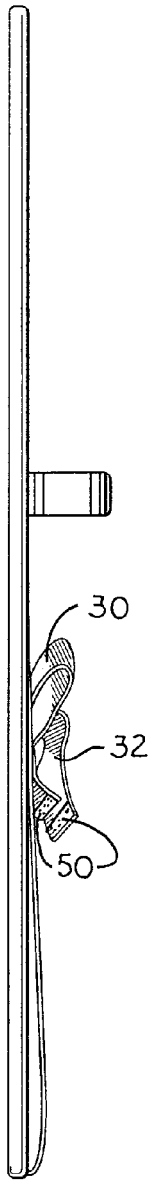
FIG. 11 is a left side view of a bench towel including ties for securing the towel to a bench.
Figure 12:
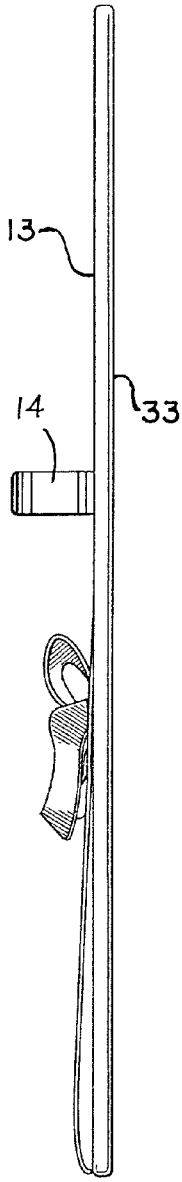
FIG. 12 is a right side view of a bench towel including ties for securing the towel to a bench.

When towel 5 is placed over the back of a workout bench, panels 16 straddle the structural framework at the top rear center of the back of a typical workout bench, as shown in FIG. 9. Panels 16 are large enough and heavy enough to hold towel 5 securely in place on the workout bench FIGS. 10-12 show another embodiment of the bench towel towel including ties 30 and 32 which are tied around a bench for more securely attaching the towel 5 to the bench. Ties 30 and 32 are pulled around behind the bench and tied together. A further embodiment includes hook and loop fastening material 50 fastened to the distal ends of ties 30 and 32 which are pulled behind the bench and their distal ends 53, 54, respectively are tightly squeezed together to fasten the towel 5 in place. A still further embodiment includes straps 34 and 36 which utilize hook and loop fastening material to secure the straps in position around a bench.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A bench towel to be used on the surface of a workout bench consisting of:

a generally rectangular cloth including a flat top surface and a bottom surface, said cloth including a main body and a pair of spaced apart panels extending from a medial interior edge of said main body and terminating at a bottom edge thereof, said panels having an alignment gap formed therebetween disposed between a medial side edge of each one of said panels and extending downward from said medial interior edge to said bottom edge a selected distance for straddling a centrally disposed structural frame member of a workout bench;

said panels folding over a portion of said workout bench with said bottom surface of said main body facing a bottom surface of said panels for holding remaining main body portion of said towel over said workout bench securely in place; and a cross strap attached to said bottom surface of said cloth at a selected position between a top edge of said cloth and said medial interior edge said cross strap attaching to said rectangular cloth parallel to said top end of said cloth and extending across a major portion thereof, said cross strap including opposing distal ends connecting to said bottom surface of said cloth and said cross strap attaching to said bottom surface of said cloth at selected connection points spaced apart from one another and a center point of said cross strap forming a generally semicircular loop extending outward from said cloth defining a handle.

2. The bench towel of claim 1, wherein said cloth is made from terry cloth.

3. The bench towel defined in claim 1 wherein said strap is formed from at least two layers of terry cloth.

4. The bench towel of claim 1, wherein said strap and said handle comprises a single layer, a double layer, a triple layer, or a multilayer type of material.

* * * * *